US009338578B2

(12) United States Patent
Choi

(10) Patent No.: US 9,338,578 B2
(45) Date of Patent: May 10, 2016

(54) LOCALIZATION CONTROL METHOD OF SOUND FOR PORTABLE DEVICE AND PORTABLE DEVICE THEREOF

(71) Applicant: Samsung Electronics Co., Ltd., Suwon-si, Gyeonggi-do (KR)

(72) Inventor: Hyunsuk Choi, Buk-gu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 173 days.

(21) Appl. No.: 14/136,744

(22) Filed: Dec. 20, 2013

(65) Prior Publication Data

US 2014/0193006 A1 Jul. 10, 2014

(30) Foreign Application Priority Data

Jan. 10, 2013 (KR) ..... 10-2013-0003006

(51) Int. Cl.
*H04R 5/02* (2006.01)
*H04S 7/00* (2006.01)

(52) U.S. Cl.
CPC ..... *H04S 7/303* (2013.01); *H04R 2499/11* (2013.01); *H04S 2400/11* (2013.01)

(58) Field of Classification Search
CPC ..... H04R 5/02
USPC ..... 381/303
See application file for complete search history.

(56) References Cited

U.S. PATENT DOCUMENTS

2012/0044222 A1 2/2012 Jung et al.
2012/0116861 A1* 5/2012 Dobyns ..... G06Q 30/0234 705/14.34
2013/0113655 A1* 5/2013 Shen ..... G01S 19/42 342/357.31
2014/0073345 A1* 3/2014 Chintalapudi ..... G01C 21/165 455/456.1

* cited by examiner

*Primary Examiner* — Simon King
(74) *Attorney, Agent, or Firm* — Jefferson IP Law, LLP

(57) ABSTRACT

A localization control method of a sound for a portable device and a portable device thereof is provided. The localization control method of a sound for a portable device includes collecting location information of the portable device and location information of a counterpart portable device when an event for communicating with the counterpart portable device by the portable device is generated, determining localization of the sound based on the location information, and outputting the sound according to the determined localization.

22 Claims, 8 Drawing Sheets

LOCALIZATION CONTROL METHOD OF SOUND FOR PORTABLE DEVICE AND PORTABLE DEVICE THEREOF

CROSS-REFERENCE TO RELATED APPLICATION(S)

This application claims the benefit under 35 U.S.C. §119 (a) of a Korean patent application filed on Jan. 10, 2013 in the Korean Intellectual Property Office and assigned Serial No. 10-2013-0003006, the entire disclosure of which is hereby incorporated by reference.

TECHNICAL FIELD

The present disclosure relates to an apparatus and method for controlling sound of a portable device. More particularly, the present disclosure relates to an apparatus and method for localizing a sound of a portable device.

BACKGROUND

As technology has progressed, portable devices are now provided with several advanced functions such as photographing a still image or a moving image, playing a music file, a moving image file, or a game, receiving a broadcast, and a wireless support of the Internet. In this regard, a portable terminal is implemented in the form of a composite multimedia player and has been developed in terms of hardware and software in order to support portability and convenience of the portable device while satisfying a desire of the user.

A location sensor included in a portable device is an example of such development. In implementation, a location sensor is able to perceive a location of the portable device equipped with the location sensor. More specifically, the portable device displays a location of a counterpart portable device according to a request of the user in a visual scheme such as a map such that the user may confirm the location of a counterpart portable device.

The above information is presented as background information only to assist with an understanding of the present disclosure. No determination has been made, and no assertion is made, as to whether any of the above might be applicable as prior art with regard to the present disclosure.

SUMMARY

However, a method of visually determining a location of the user or a counterpart user as currently implemented is not intuitive because the user must perceive an exact location by viewing a screen. In order to perceive the location of a counterpart user during a call, the user must stop talking during the call in order to view a display unit of the portable device or must ask the counterpart user to confirm their location. Accordingly, there is a need for an improved apparatus and method for providing a localization control method for a portable device.

Aspects of the present disclosure are to address at least the above-mentioned problems and/or disadvantages and to provide at least the advantages described below. Accordingly, an aspect of the present disclosure is to provide a localization control method of a sound for a portable device to control localization of a sound by controlling a sound pressure of left/right sound output units based on a relative location between a user of the portable device and a counterpart user, and a portable device thereof.

Another aspect of the present disclosure is to provide a localization control method of a sound for a portable device capable of intuitively determining a location of a counterpart portable device by a user of the portable device through a localization of a sound, and a portable device thereof.

In accordance with an aspect of the present disclosure, a localization control method of a sound for a portable device is provided. The method includes collecting location information of the portable device and location information of a counterpart portable device when an event for communicating with the counterpart portable device by the portable device is generated, determining localization of the sound based on the location information, and outputting the sound according to the determined localization.

The location information transmitted from the counterpart portable device may include at least one of information of the counterpart portable device's actual location or information of location designated by the counterpart portable device. The collecting of the location information may include measuring at least one of a latitude, a longitude, an azimuth, or an azimuth angle of the portable device and the counterpart portable device.

The collecting of the location information may include transmitting a request message for collecting the location information to the counterpart portable device, and receiving the location information transmitted from the counterpart portable device.

The determining of the localization of the sound may include calculating a relative azimuth angle indicating an azimuth angle of the counterpart portable device for an azimuth angle of the portable device, based on the location information of the portable device and the counterpart portable device, and determining localization of the sound according to the relative azimuth angle. The outputting of the sound may include determining a static pressure of a left speaker and determining a static pressure of a right speaker of the portable device according to the localization, and outputting the sound to the left speaker and the right speaker according to the static pressure. The determining of the static pressures of the left speaker and the right speaker may include determining the static pressure so that a difference between the static pressures of the left speaker and the right speaker may be reduced, in proportion as the counterpart portable device approaches a front of the portable device, determining the static pressure so that the static pressure of the left speaker may be more increased than the static pressure of the right speaker, in proportion as the counterpart portable device approaches a left side of the portable device, determining the static pressure so that the static pressure of the right speaker may be more increased than the static pressure of the left speaker, in proportion as the counterpart portable device approaches a right side of the portable device, and determining the static pressure so that the static pressures of the left speaker and the right speaker may be reduced, in proportion as the counterpart portable device approaches a rear side of the portable device.

The determining of the localization of the sound may include calculating a height difference between the portable device and the counterpart portable device, by using location information of the portable device and the counterpart portable device, and determining the localization of the sound according to the height difference.

The outputting of the sound may include determining the static pressures of the left speaker and the right speaker so that a difference of the static pressures of the left speaker and the right speaker may be reduced, in proportion to the height difference, and outputting the sound to the left speaker and the right speaker according to the static pressure. The outputting of the sound may include transmitting data including the static pressure to at least one of a speaker, an earphone, a headset, or a headphone connected to the portable device. The sound may be a receiving sound or a bell sound.

The localization control method of a sound for a portable device may further include collecting changed location information of the portable device and the counterpart portable device when a location change event of at least one of the portable device or the counterpart portable device, and determining the localization of the sound based on the changed location information.

The collecting of the location information may include determining whether a localization mode of the portable device and the counterpart portable device is set, and collecting location information of the portable device and the counterpart portable device when the localization mode of the portable device and the counterpart portable device is set.

In accordance with another aspect of the present disclosure, a portable device is provided. The portable device includes a communication unit configured to transmit and receive data to and from a counterpart portable device, a sensor unit configured to collect location information, a sound output unit configured to output a sound, and a controller configured to, when an event for communicating with the counterpart portable device is generated, collect the location information through the sensor unit, to collect location information transmitted from the counterpart portable device through the communication unit, determine localization of the sound based on the location information and the location information transmitted from the counterpart portable device, and control the sound output unit to output the sound according to the determined localization.

The location information transmitted from the counterpart portable device may be at least one of information of the counterpart portable device's actual location and information of location designated by the counterpart portable device. The sensor unit may include at least one of a Global Positioning System (GPS) sensor to collect latitude information and longitude information by using a GPS satellite signal, a geomagnetic sensor to collect azimuth information and azimuth angle information by measuring a geomagnetic field, and a gyro sensor to collect azimuth information and azimuth angle information based on a rotation angle for a three-dimensional axis. The controller may control the communication unit to transmit a request message for collecting the location information to the counterpart portable device, and to receive the location information transmitted from the counterpart portable device. The controller may determine localization of the sound based on the azimuth angle and an azimuth angle of the counterpart portable device. The sound output unit includes a left speaker and a right speaker, and the controller may determine the static pressure so that a difference between the static pressures of the left speaker and the right speaker may be reduced, in proportion as the counterpart portable device approaches a front of the portable device, determine the static pressure so that the static pressure of the left speaker may be more increased than the static pressure of the right speaker, in proportion as the counterpart portable device approaches a left side of the portable device, determine the static pressure so that the static pressure of the right speaker may be more increased than the static pressure of the left speaker, in proportion as the counterpart portable device approaches a right side of the portable device, and determine the static pressure so that the static pressures of the left speaker and the right speaker may be reduced, in proportion as the counterpart portable device approaches a rear side of the portable device. The sensor unit may include at least one of a GPS sensor to measure an altitude by using a GPS signal, an altitude sensor to measure the altitude based on an atmospheric pressure or a satellite signal, or an atmospheric pressure sensor to measure the atmospheric pressure. The sound output unit may include a left speaker and a right speaker, and the controller may determine a height difference with the counterpart portable device based on the location information, and may determine the static pressures of the left speaker and the right speaker so that a difference of the static pressures of the left speaker and the right speaker may be reduced, in proportion to the height difference. The controller may collect changed location information when at least one location change event is generated from the location information and the counterpart portable device, and determine localization of the sound based on the changed location information.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
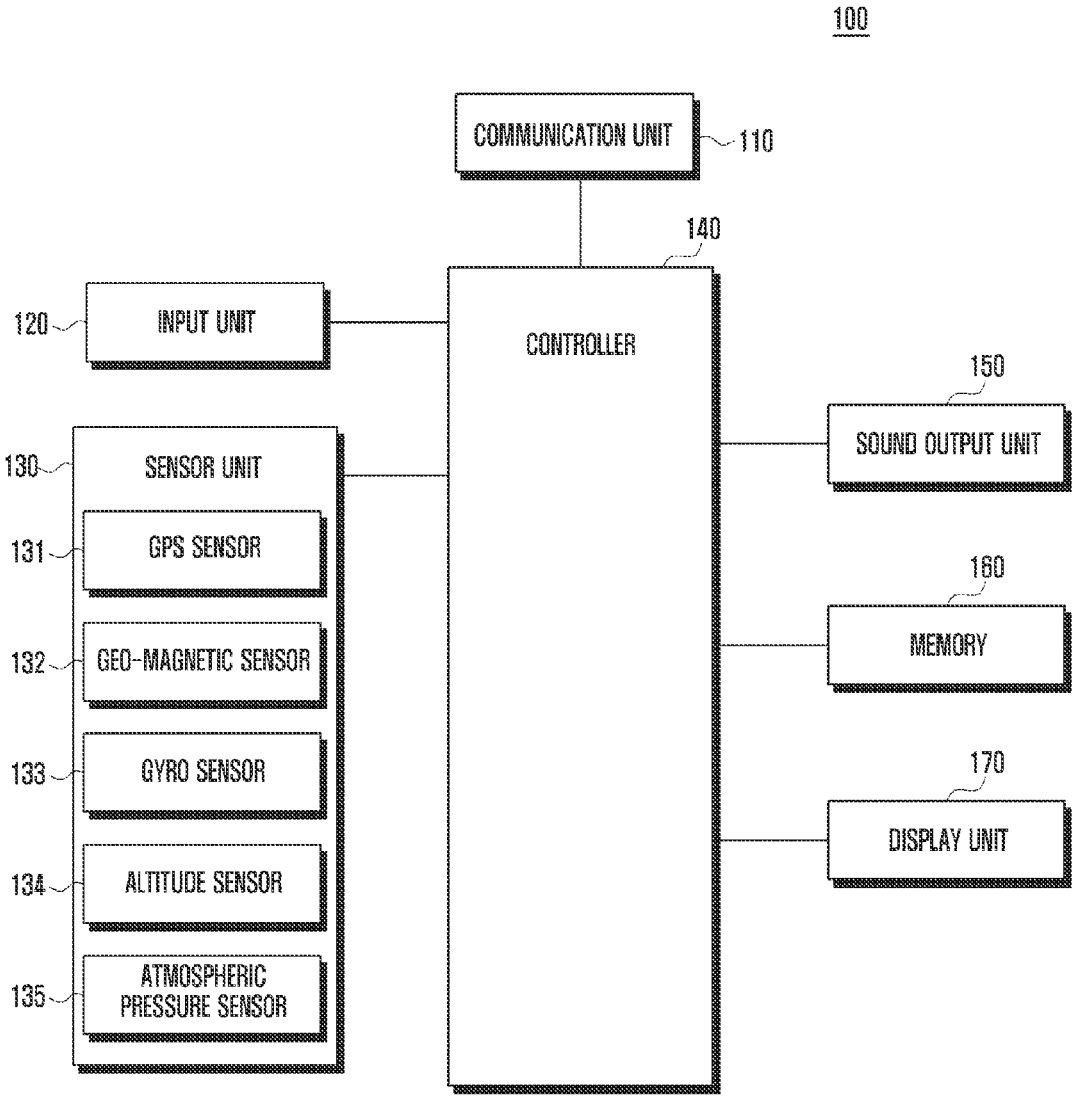
FIG. 1 is a block diagram illustrating a configuration of a portable device according to an embodiment of the present disclosure.

The following description with reference to the accompanying drawings is provided to assist in a comprehensive understanding of embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Embodiments of the present disclosure may be applicable to the localization control of a sound of a portable device including a location sensor.

Further, embodiments of the present disclosure may be applicable to any kind of device, such as a portable device, that includes or may include a location sensor as well as a general electronic terminal such as a smart phone, a portable terminal, a mobile terminal, a Personal Digital Assistant (PDA), a Portable Multimedia Player terminal (PMP), a note pad, a Wibro terminal, a tablet PC, and the like.

As used herein, the term "localization" refers to a direction of a sound, that is, a direction from which a sound flows. The localization is determined according to a synthesized result of sounds of left and right speakers. The localization is controlled by using a pressure difference or a time difference of left/right speakers. The localization may include a sense of distance as well as a direction of a sound in some cases.

Unless defined otherwise, the terms, including technical and scientific terms, used in this specification may have the meaning that can be commonly apprehended by those skilled in the art. The terms, such as the terms defined in a commonly-used dictionary, must be interpreted based on the context of the related technology and must not be interpreted ideally or excessively.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

For example, in the specification and claims, as used herein, the term "location information transmitted by a counterpart portable device" signifies the information of the counterpart portable device's actual location or the location information designated by the counterpart portable device.

Hereinafter, various embodiments of the present disclosure will be described with reference to the accompanying drawings.

FIG. 1 is a block diagram illustrating a configuration of a portable device according to an embodiment of the present disclosure.

Referring to FIG. 1, the portable device 100 may include a communication unit 110, an input unit 120, a sensor unit 130, a controller 140, a sound output unit 150, a memory 160, and a display unit 170.

The communication unit 110 may include at least one module to perform a wireless communication between the portable device 100 and a wireless communication system or between the portable device 100 and a mobile communication system in which the portable device 100 is located. In more detail, the communication unit 110 transmits and receives a wireless signal to and from at least one of a base station, another portable device, or a server on a mobile communication network. The wireless signal may include data of various forms according to transmission/reception of a sound call signal, an image call signal, or a character/multimedia message. Further, the communication unit 110 may exchange data externally by using a communication technology such as Wireless LAN (WLAN), Wi-Fi, Wireless broadband (Wibro), World Interoperability for Microwave Access (Wimax), High Speed Downlink Packet Access (HSDPA), and the like. In particular, the communication unit 110 may receive a Global Positioning System (GPS) satellite signal from a GPS satellite.

According to an embodiment of the present disclosure, the communication unit 110 may transmit and receive data to and from a counterpart portable device according to generation of a call event. Further, the communication unit 110 may transmit a message, requesting location information, to a counterpart portable device, and receive location information transmitted from the counterpart portable device, under control of the controller 140. In this case, the location information transmitted from the counterpart portable device may include at least one of information about the counterpart portable device's actual location (e.g., a location at which the counterpart portable device is located when transmitting the location information) or information about a location designated by the counterpart portable device.

The input unit 120 detects a user's input and transfers an input signal corresponding to the user's input to the controller 140. The input unit 120 may be include a key pad, a dome switch, a touch pad (resistive/capacitive type), a jog wheel, a jog switch, a finger mouth, a wheel, and the like.

The input unit 120 may include a touch sensor, a proximity sensor, an electromagnetic sensor, a pressure sensor, and the like. The input unit 120 may detect a touch input or a proximity input of the user through the sensor unit 130. The input unit 120 may be configured by a sensor which is attached on a pad in the form of a film or by an input pad coupled in the form of a panel. For example, the input unit 120 may be configured by an input pad of an Electro Magnetic Resonance (EMR) or Eletro Magnetic Interference (EMI) scheme using an electromagnetic sensor.

The input unit 120 may form a layer structure with the display unit 170 to be described later and may operate as an input screen. For example, the input unit 120 may be configured by a Touch Screen Panel (TSP) including an input pad equipped with a touch sensor and coupled with the display unit 170. The input unit 120 forming the layer structure with the display unit 170 may be named as a touch screen.

According to an embodiment of the present disclosure, the input unit 120 may detect an input for placing a phone call. The input for placing a phone call may be generated by selection of a phone number of a counterpart, selection of a call menu, selection of a call button, and the like.

The sensor unit 130 may include a plurality of sensors to detect a current state of the portable device 100. The sensor unit 130 may generate a control signal corresponding to the detected state and transfer the control signal to the controller 140. The sensor unit 130 may include a GPS sensor 131, a geo-magnetic sensor 132, a gyro sensor 133, an altitude sensor 134, and an atmospheric pressure sensor 135.

The GPS sensor 131 generates current location information of the portable device 100 based on a GPS signal received from a GPS satellite through the communication unit 110.

The GPS sensor 131 determines a latitude, a longitude, and an altitude for the portable device 100 through triangulation by using a GPS signal received from a plurality of GPS satellites.

The geo-magnetic sensor 132 measures the intensity of a 2-axis or 3-axis magnetic field, and measures a direction of a magnetic field affecting the geo-magnetic sensor 132 based on a vector addition of the measured intensity of the magnetic field. The geo-magnetic sensor 132 determines an azimuth indicated by a reference surface of the portable device based on a direction of the magnetic field. The gyro sensor 133 is a sensor to measure a rotation angle of the portable device 100, and may detect a rotated angle for a reference three-dimensional axis. For example, the gyro sensor 133 may detect a rotated angle for the x, y, and z axes, that is, pitch, roll, and yaw with the center of the portable device 100 as an original point. The altitude sensor 134 measures an altitude of the portable device 100 based on a surrounding atmospheric pressure or a signal received from a satellite. The atmospheric pressure sensor 135 measures a pressure applied to the portable device 100 according to surrounding air to measure a surrounding atmospheric pressure.

In addition, the sensor unit 130 may include at least one of a motion sensor, an acceleration sensor, a tilt sensor, and the like to detect location information of the portable device 100. According to an embodiment of the present disclosure, the sensor unit 130 may collect location information including a latitude, a longitude, an azimuth, an azimuth angle, and an altitude. The sensor unit 130 may collect location information during a call under control of the controller 140. For example, the sensor unit 130 may collect location information periodically during a call.

The controller 140 may control respective constituent elements for an overall operation of the portable device 100. For example, the controller 140 may control localization of a sound output from the sound output unit 150 based on a relative location between the portable device 100 and a counterpart portable device 100-1.

According to an embodiment of the present disclosure, during a call event with the counterpart portable device 100-1, the controller 140 collects location information through the sensor unit 130, and collects location information transmitted from the counterpart portable device 100-1 through the communication unit 110. In this case, location information transmitted from the counterpart portable device 100-1 may include at least one of information of the actual location of the counterpart portable device 100-1 or information of the location designated by the counterpart portable device 100-1. Further, according to an embodiment of the present disclosure, the controller 140 determines localization of the sound based on the location information and location information transmitted from the counterpart portable device 100-1, and controls the sound output unit 150 to output the sound according to the determined localization.

An operation of the controller 140 will be described in more detail below with reference to following drawings.

The sound output unit 150 may include at least one sound output module to output a sound signal. The sound output unit 150 outputs a sound signal received through the communication unit 110 or stored in the memory 160 in call reception, a call mode, a recording mode, a voice recognition mode, and the like. The sound output unit 150 may include a module to modulate a sound source into an analog signal or a digital signal or to amplify the sound source and a module to apply an equalizer to the sound source. The sound output unit 150 may include a module to modulate a sound source manufactured in a mono format into a stereo format or modulate a sound source manufactured in the stereo format into the mono format.

According to an embodiment of the present disclosure, the sound output unit 150 may include two or more speakers. For example, the sound output unit 150 may include a left speaker and a right speaker. When the sound source is manufactured in the mono format, the sound output unit 150 may include a splitter for splitting the sound source into a left signal and a right signal.

When an ear phone is connected to the sound output unit 150 through a connector or a jack, left/right ends of the ear phone may correspond to a left speaker and a right speaker, respectively. According to an embodiment of the present disclosure, the sound output unit 150 outputs a sound according to localization determined by the controller 140. In this case, the sound may include a receiving sound, a bell sound, and the like.

The memory 160 may store programs or commands for the portable device 100. The controller 140 may execute programs or commands stored in the memory 160. The memory 160 may include a storage medium having at least one type among a flash memory type, a hard disk type, a multimedia card micro type, a memory of a card type (e.g., an SD or XD memory), Random Access Memory (RAM), Static Random Access Memory (SRAM), Read-Only Memory (ROM), Electrically Erasable Programmable Read-Only Memory (EEPROM), Programmable Read-Only Memory (PROM), Magnetic RAM (MRAM), a magnetic disc, and an optical disc.

According to an embodiment of the present disclosure, the memory 160 may store a sound source of a bell sound set by the user. The memory 160 may temporarily or permanently store location information of the portable device 100.

The display unit 170 displays (outputs) information processed by the portable device 100. For example, the display unit 170 displays information corresponding to an application, a program, a service which is currently driving along with User Interface (UI) or Graphic User Interface (GUI).

The display unit 170 may have a mutual layer structure with the input unit 120 and the sensor unit 130 and operate as a touch screen. In this case, the display unit 170 operating as the touch screen may perform a function of the input device.

Many elements shown in FIG. 1 are not essential, and it is to be understood that the portable device 100 may have more or fewer elements than those shown in FIG. 1.

Figure 2:
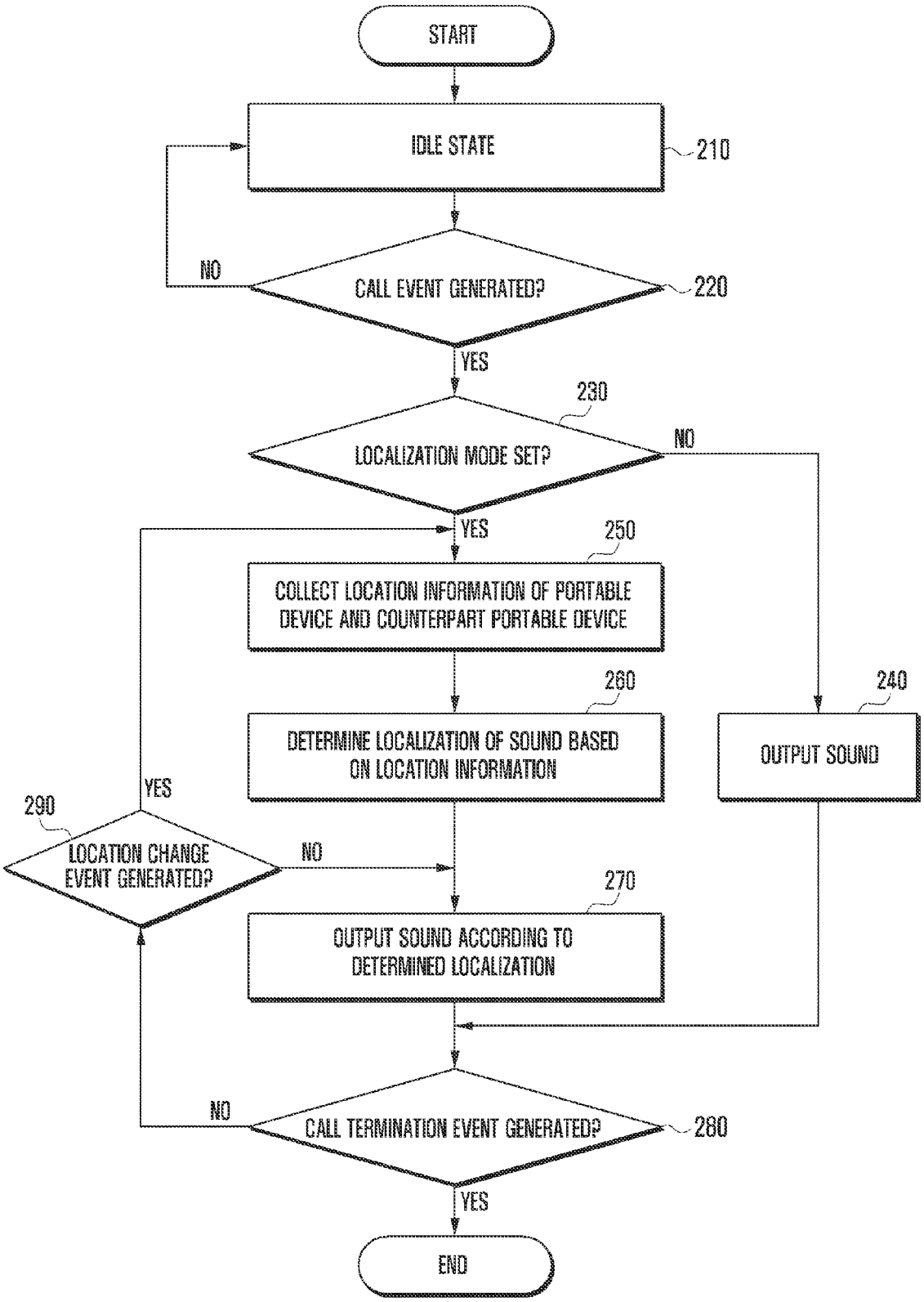
FIG. 2 is a flowchart illustrating a localization control method of a sound for a portable device according to an embodiment of the present disclosure.

FIG. 2 is a flowchart illustrating a localization control method of a sound for a portable device according to an embodiment of the present disclosure. As an example, the localization control method of a sound for a portable device according to the present disclosure illustrates that the portable device 100 calls a counterpart portable device 100-1. However, the present disclosure is not limited thereto, but can be applicable to various embodiments including a case of exchanging a character message, and a case of communicating through an application such a Social Networking Service (SNS), a messenger, and the like.

Referring to FIG. 2, the controller 140 may operate in an idle state at operation 210. In the idle state, the controller 140 may operate in a lock mode, a standby mode, and the like, or drive an arbitrary application, a program or a service.

In an embodiment of the present disclosure, the controller 140 may drive a call application. Further, the controller 140 may control the display unit 170 to display a lock screen, an idle screen, a contact address list, a call list according to a call application, a dial pad screen, and the like.

The controller 140 determines whether a call event occurs at operation 220. The call event may be generated according to reception of a call corresponding to a call execution request from the outside or an input for the call execution request.

When the call is received through the communication unit 110 or an input corresponding to the call execution request is detected through the input unit 120, the controller 140 may determine that the call event is generated. The controller 140 may acquire information for executing a call, simultaneously with generation of the call event. For example, the controller 140 may acquire a phone number of a counterpart of call, and base station information of a counterpart of call.

The controller 140 may acquire the information from a call received through the communication unit 110 or according to a user input through the input unit 120. If the call event is not generated, the controller 140 may return to the idle state and repeat the foregoing operation.

On the other hand, if the call event is generated, the controller 140 may determine whether a localization mode is set at operation 230. The localization mode is a mode to control the localization of a sound output through a sound output unit 150 according to a location of the portable device 100 of a counterpart for call. The localization mode may be set upon manufacture of the portable device 100 or according to a user input. The controller 140 may determine whether a localization mode of the portable device 100 is set.

In an embodiment of the present disclosure, the controller 140 may also determine whether a localization mode of a counterpart portable device 100-1 is set.

In more detail, the controller 140 may control the communication unit 110 to transmit a request message for confirming the setting of a localization mode to the counterpart portable device 100-1. In this case, the controller 140 may first determine whether the counterpart portable device 100-1 is a portable device which can set a localization mode. For example, the controller 140 may transmit a message for confirming whether the counterpart portable device 100-1 can set a localization mode to the counterpart portable device 100-1.

The controller 140 may receive a response message from the counterpart portable device 100-1 through the communication unit 110. The response message may include information of whether the counterpart portable device 100-1 can set the localization mode and information of whether to set the localization mode. The controller 140 may determine whether the location mode of the counterpart portable device 100-1 is set based on the received response message.

A localization control method of a sound for a portable device of the present disclosure may be performed in a state in which both the portable device 100 of the user and the counterpart portable device 100-1 are set in a localization mode.

In a localization control method of a sound for a portable device, it is assumed that the portable device 100 and the counterpart portable device 100-1 share location information. Accordingly, the portable device 100 may control localization of the sound when it is accepted that each of the portable device 100 and the counterpart portable device 100-1 share location information with another portable device by setting the localization mode.

When the localization mode is not set, the controller 140 may output the sound at operation 240. If the localization mode is not set in at least one of the portable device 100 or the counterpart portable device 100-1, the controller 140 may output the sound output through the sound output unit 150 through general control. In this case, the controller 140 may output a message, a warning sound, a vibration, and the like to report that the portable device 100 or the counterpart portable device 100-1 is not set to the localization mode. On the other hand, when the localization mode is set, the controller 140 collects the location information of the portable device 100 and the counterpart portable device 100-1 at operation 250.

The controller 140 may collect location information of the portable device 100 using any of various sensors included in the sensor unit 130. In an embodiment, the controller 140 may collect the location information including a latitude and a longitude of the portable device 100 by using the GPS sensor 131.

Figure 3:
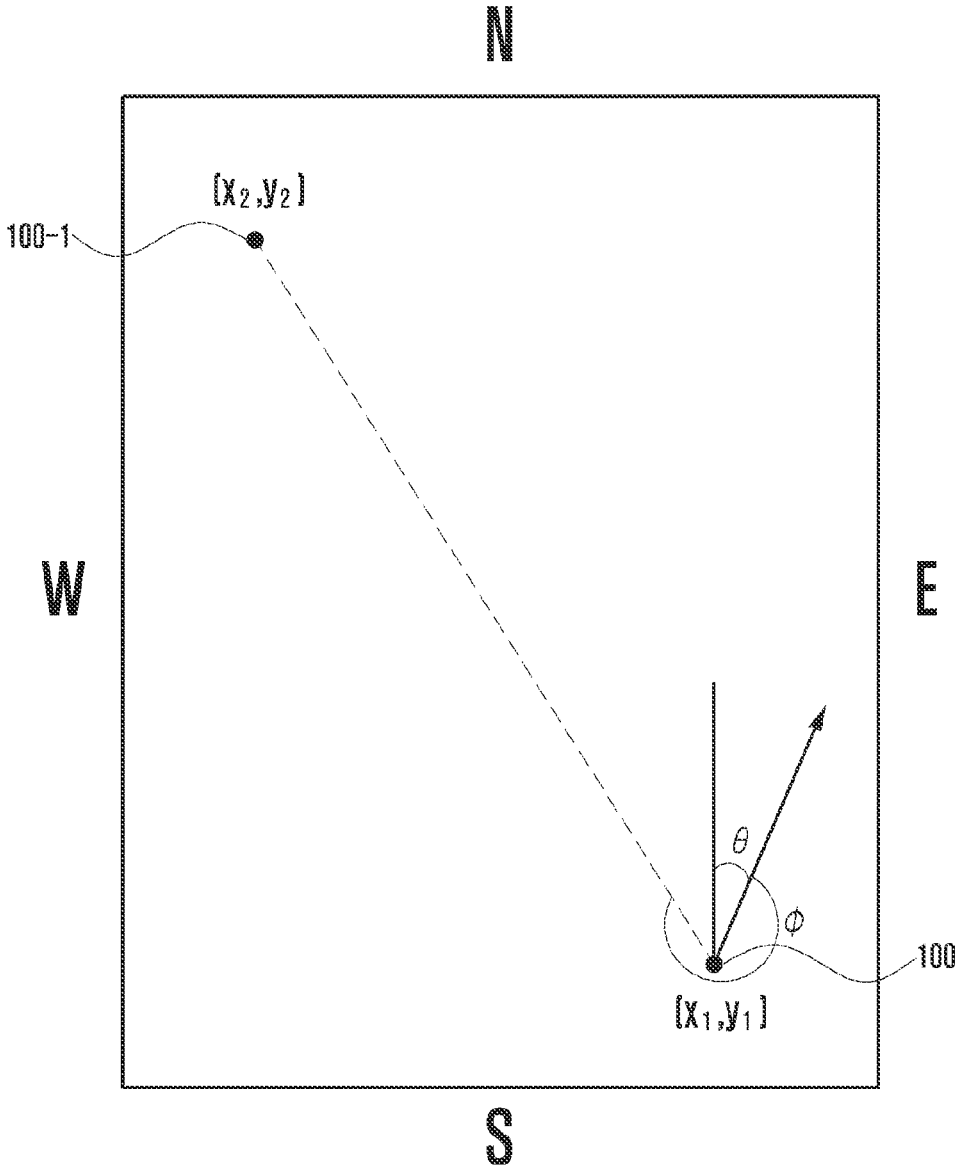
FIG. 3 is a diagram illustrating a portable device, and a latitude, a longitude, an azimuth angle, and a relative azimuth angle of the portable device according to an embodiment of the present disclosure.

FIG. 3 is a diagram illustrating a portable device, and a latitude, a longitude, an azimuth angle, and a relative azimuth angle of the portable device according to an embodiment of the present disclosure.

Referring to FIG. 3, the controller 140 may indicate the latitude and the longitude of the portable device 100 as two dimensional coordinates (x1, y1). Further, the controller 140 may collect location information including a direction indicated by the portable device 100 by using a geo-magnetic sensor 132 or a gyro sensor 133. As shown in FIG. 3, the controller 140 collects location information including an azimuth (east/west/south/north) and an azimuth angle Θ of a direction indicated by a reference surface of the portable device 100. In this case, the reference surface may be set upon manufacture of the portable device 100 or may be flexibly determined according to a call posture of the user, and may be a surface corresponding to a direction that the user faces. The azimuth angle Θ may refer to an angle which ranges from 0° to 360° measured clockwise (east azimuth direction) based on a north azimuth.

The controller 140 collects location information transmitted from the counterpart portable device 100-1 for a call. In more detail, the controller 140 may transmit a message requesting location information to the counterpart portable device 100-1 through the communication unit 110. The controller 140 may receive a message in response to the request message through the communication unit 110. The response message may include location information of the counterpart portable device 100-1. In this case, the location information transmitted from the counterpart portable device 100-1 may be at least one of information about the actual location of the counterpart portable device 100-1 or information of a location designated by the counterpart portable device 100-1. Further, for example, the location information may include the latitude and the longitude of the counterpart portable device 100-1. The latitude and the longitude of the counterpart portable device 100-1 may be indicated as two dimensional coordinates (x2, y2) as shown in FIG. 3.

In some cases, the location information may include an azimuth or an azimuth angle of the counterpart portable device 100-1.

In a localization control method of a sound for a portable device of the present disclosure, since the sound may be controlled by only a relative location of the counterpart portable device 100-1 to the portable device 100, azimuth information of the counterpart portable device 100-1 may not be required. The location information included in the response message may be measured through a GPS sensor, a geomagnetic sensor, a gyro sensor, and the like included in the counterpart portable device 100-1. The controller 140 collects location information of the counterpart portable device 100-1 included in the response message.

When the location information of the counterpart portable device 100-1 cannot be collected due to communication impossibility or communication error, the controller 140 may output a message, a warning sound, a vibration, and the like to report communication impossibility, communication error, or location information collection impossibility.

According to an embodiment of the present disclosure, the controller 140 may collect altitude information of the portable device 100 and the counterpart portable device 100-1 as the location information.

Figure 4:
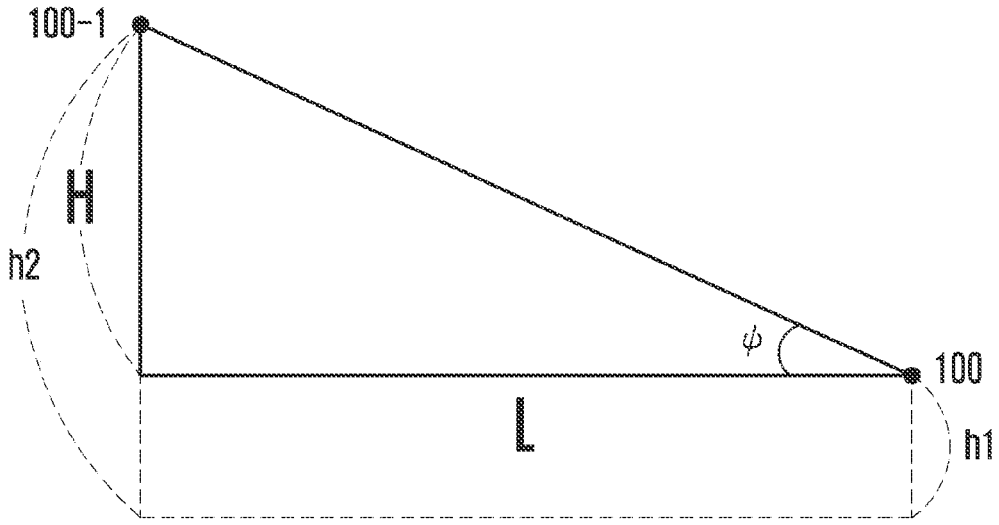
FIG. 4 is a diagram illustrating a portable device, and a distance, a relative height, and a relative altitude of the portable device according to an embodiment of the present disclosure.

FIG. 4 is a diagram illustrating a portable device, and a distance, a relative height, and a relative altitude of the portable device according to an embodiment of the present disclosure.

Referring to FIG. 4, the controller 140 may determine the altitude h1 of the portable device 100 by using a GPS sensor 131, an altitude sensor 134, and an atmospheric pressure sensor 135. Further, the controller 140 may determine an altitude h2 of the counterpart portable device 100-1 based on the location information of the counterpart portable device 100-1 through the communication unit 110.

Although the foregoing embodiment has illustrated several methods of collecting location information of the portable device 100 and the counterpart portable device 100-1, the present disclosure is not limited thereto, but may collect elements of various location information to determine a relative location of the portable device 100 and the counterpart portable device 100-1.

Referring again to FIG. 2, the controller 140 determines localization of the sound based on the location information at operation 260.

The controller 140 determines localization of the sound based on the collected location information. In more detail, the controller 140 determines a direction in which the counterpart portable device 100-1 is located relative to the portable device 100 using the collected location information. The controller 140 may determine a direction in which the counterpart portable device 100-1 exists for a location of the portable device 100, based on the latitude and the longitude (x1, y1) of the portable device 100 and the latitude and the longitude (x2, y2) of the counterpart portable device 100-1.

The controller 140 may use an azimuth or an azimuth angle of the portable device 100 in order to determine a direction in which the counterpart portable device 100-1 exists based on a direction that the user actually looks. In this case, the azimuth or the azimuth angle Θ may be measured based on a reference surface of the portable device 100 corresponding to a direction that the user actually looks as described above.

The controller 140 may indicate a direction of the counterpart portable device 100-1 for the portable device 100 as a relative azimuth angle Φ.

Figure 5:
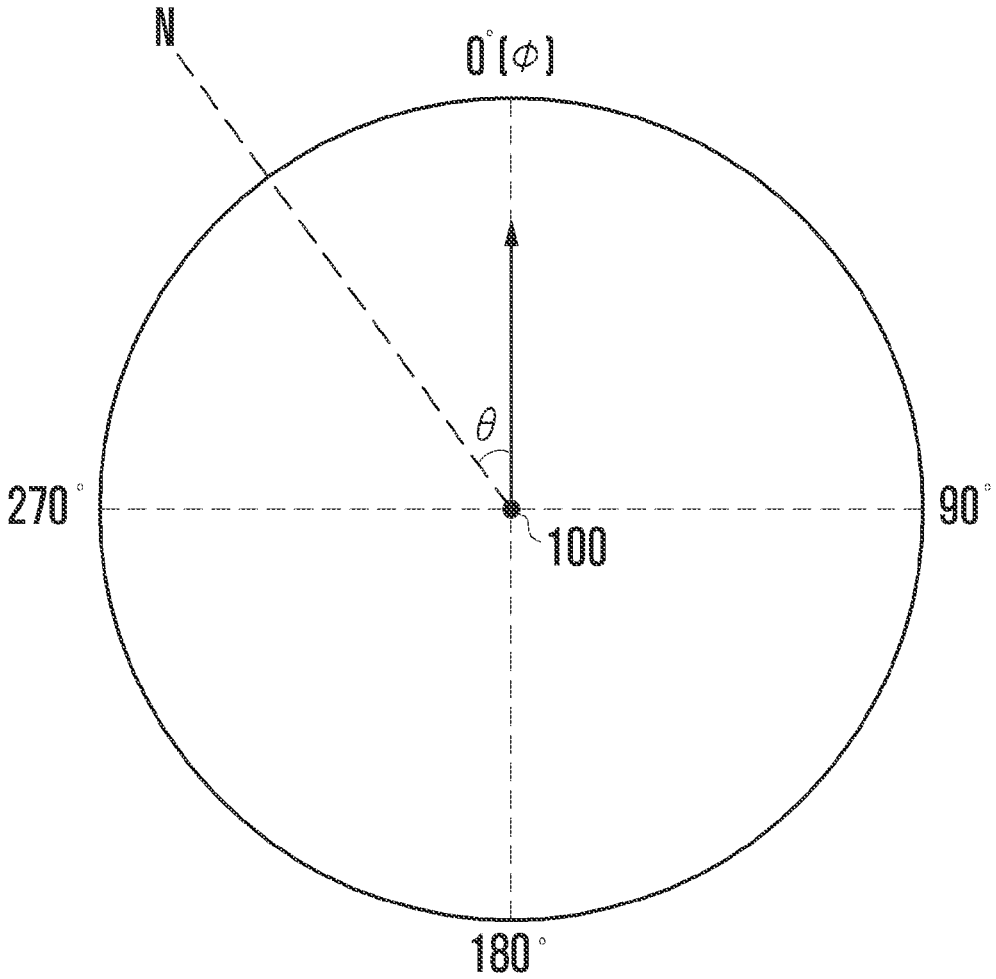
FIG. 5 is a diagram illustrating a relative azimuth angle according to an embodiment of the present disclosure.

FIG. 5 is a diagram illustrating a relative azimuth angle according to an embodiment of the present disclosure.

Referring to FIG. 5, the controller 140 may set the azimuth angle Θ of the portable device 100 to 0° as a reference angle, and may determine a direction of the counterpart portable device 100-1 to set as a relative azimuth angle Θ. As shown in FIG. 5, when the relative azimuth angle Φ is 0° or 360°, the counterpart portable device 100-1 is located in front of the portable device 100. If the relative azimuth angle Φ is increased from 0° to 90°, the counterpart portable device 100-1 moves from a front to a right side of the portable device 100, such that the counterpart portable device 100-1 is located at a right side with respect to the portable device 100, when the relative angle Φ is 90°.

If the relative azimuth angle Φ is increased from 90° to 180°, the counterpart portable device 100-1 moves from a right side to a rear side of the portable device 100 (e.g., behind the portable device 100), such that the counterpart portable device 100-1 is located at a rear side of the portable device 100, when the relative angle Φ is 180°.

If the relative azimuth angle Φ is increased from 180° to 270°, the counterpart portable device 100-1 moves from a rear side to a left side of the portable device 100, such that the counterpart portable device 100-1 is located at a left side of the portable device 100, when the relative angle Φ is 270°.

If the relative azimuth angle Φ is increased from 270° to 360°, the counterpart portable device 100-1 moves from a left side to a front side of the portable device 100, such that the counterpart portable device 100-1 is located in front of the portable device 100, when the relative angle Φ is 360°.

The controller 140 determines a direction from which a sound flows, that is, localization of the sound, based on the relative azimuth angle Φ of the determined counterpart portable device 100-1.

Further, the controller 140 may determine a distance between the portable device 100 and the counterpart portable device 100-1 based on the latitude and the longitude (x1, y1) of the portable device 100 and the latitude and the longitude (x2, y2) of the counterpart portable device 100-1.

In addition, the controller 140 may determine a relative height H between the portable device 100 and the counterpart portable device 100-1 based on the altitude h1 of the portable device 100 and the altitude h2 of the counterpart portable device 100-1.

Referring again to FIG. 4, the relative height H may be determined using a difference between the altitude h1 of the portable device 100 and the altitude h2 of the counterpart portable device 100-1. The relative height H may be indicated as a relative altitude Ψ using the distance L and the relative height H between the portable device 100 and the counterpart portable device 100-1 as shown in FIG. 4. In this case, the relative altitude Ψ may be determined using Equation (1).

$$\Psi = \tan^{-1}\frac{L}{H} \qquad \text{Equation (1)}$$

In Equation (1), Ψ is a relative altitude, L is a distance between the portable device 100 and the counterpart portable device 100-1, and H is a relative height.

The relative altitude Ψ may have a value which ranges from −90° to 90°. In an embodiment of the present disclosure, the controller 140 may determine localization of a sound by reflecting the determined relative distance L and the relative height H (or relative altitude Ψ).

Referring again to FIG. 2, the controller 140 outputs a sound according to the determined localization at operation 270.

The controller 140 controls an attribute of the sound output through the sound output unit 150 according to the determined localization. In more detail, the controller 140 may control sound pressure for two or more speakers constituting the sound output unit 150, in response to the determined localization. For example, the sound output unit 150 may include a first speaker and a second speaker which are respectively provided at a left side and a right side. In an embodiment of the present disclosure, the controller 140 controls the sound according to the localization determined based on the direction of the counterpart portable device 100-1 for the portable device 100, that is, a relative azimuth angle Φ.

For example, when the localization is a front side, that is, when the counterpart portable device 100-1 is located in front of the portable device 100, the controller 140 may control the sound pressure of a left speaker and a right speaker to be identical. As the localization is moved from the front side to a right side, the controller 140 may control a static pressure so that a static pressure of the right speaker may be relatively greater than that of the left speaker.

Figure 6:
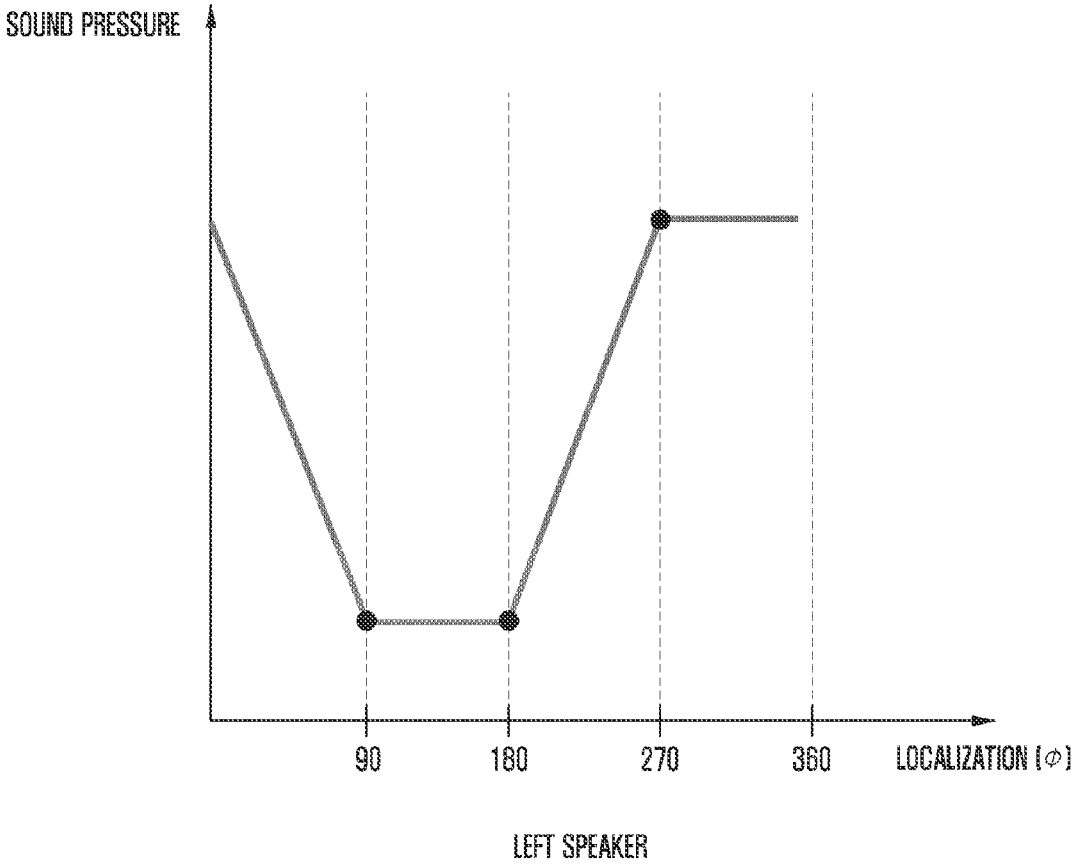
FIG. 6 is a graph illustrating an example of controlling a sound pressure of a left speaker according to an embodiment of the present disclosure.
Figure 7:
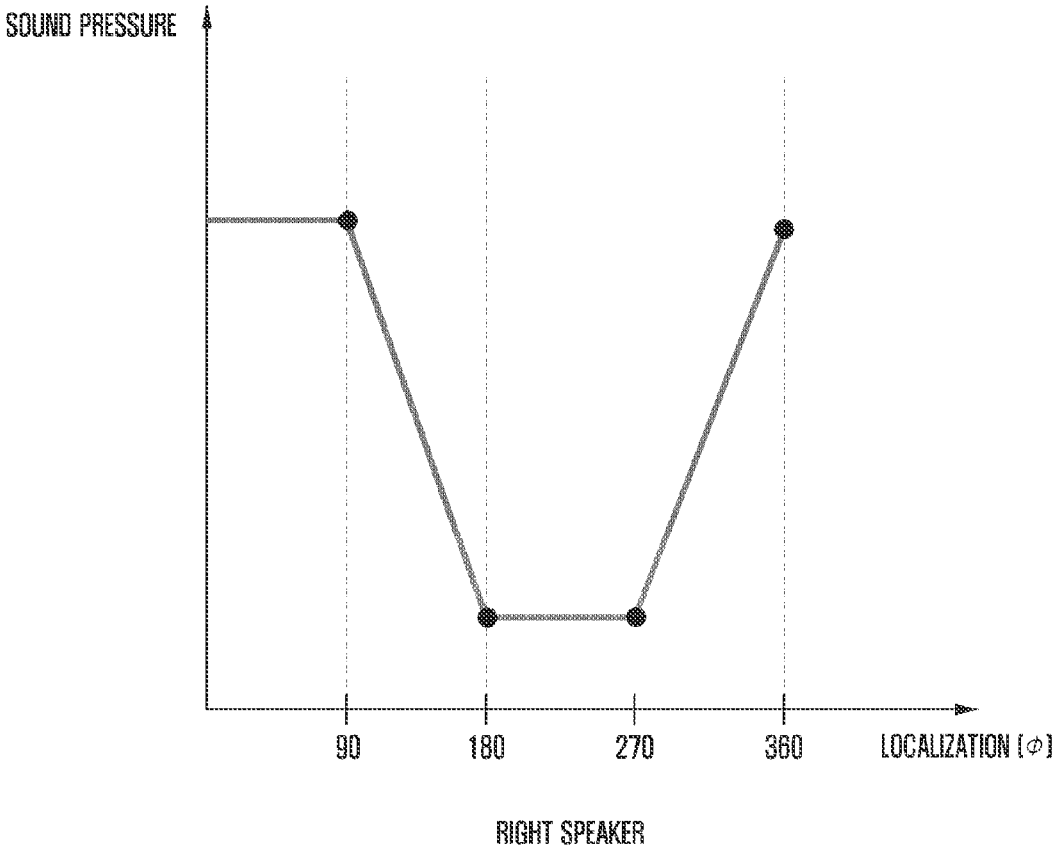
FIG. 7 is a graph illustrating an example of controlling a sound pressure of a right speaker according to an embodiment of the present disclosure.

FIG. 6 is a graph illustrating an example of controlling a sound pressure of a left speaker according to an embodiment of the present disclosure. FIG. 7 is a graph illustrating an example of controlling a sound pressure of a right speaker according to an embodiment of the present disclosure.

Referring FIGS. 6 and 7, when the relative azimuth angle Φ is 0° or 360°, the controller 140 may control the sound pressure of the left speaker and the right speaker to be identical. In this case, the sound pressure of the left speaker and the right speaker may have a maximum value. When the relative azimuth angle Φ is increased from 0° to 90°, the controller 140 reduces the sound pressure of the left speaker as shown in FIG. 6. On the other hand, as shown in FIG. 7, the controller 140 may move a direction from which a sound flows to a right side by identically maintaining the sound pressure of the right speaker.

When the localization is a right side, that is, when the counterpart portable device 100-1 is located in a right side of the portable device 100, the controller 140 may control the static pressure of the right speaker into a maximum value or control the static pressure of the left speaker into a minimum value. In this case, as the localization gradually moves from the right side to the left side, the controller 140 may gradually reduce the static pressure of the right speaker.

In more detail, when the relative azimuth angle Φ is 90°, the controller 140 may set sound pressure of the left speaker to a minimum value and may control the static pressure of the right speaker to a maximum value. When the relative azimuth angle Φ is increased from 90° to 180°, the controller 140 may move the direction from which a sound flows to a rear surface by reducing the sound pressure of the right speaker.

In an embodiment of the present disclosure, when the localization is a rear side, that is, when the counterpart portable device 100-1 is located at a rear surface of the portable device 100 (e.g., behind the portable device 100), the controller 140 controls the static pressure of both of the left speaker and the right speaker to a minimum value to distinguish from a case where the localization is a front in view of a user. Further, as the localization is moved from a rear surface to a left side, the controller 140 may control static pressure so that static pressure of the left speaker may be relatively greater than that of the right speaker.

Referring still to FIGS. 6 and 7, when the relative azimuth angle Φ is 180°, the controller 140 controls the sound pressure of the left speaker and the right speaker to be identical. In this case, the sound pressure of the left speaker and the right speaker may be controlled to a minimum value. As the relative azimuth angle Φ is increased from 180° to 270°, the controller 140 increases sound pressure of the left speaker as shown in FIG. 6. On the other hand, the controller 140 may identically maintain the sound pressure of the right speaker to move a direction from which a sound flows to a left side as shown in FIG. 7.

When the localization is a left side, that is, when the counterpart portable device 100-1 is located in a left side of the portable device 100, the controller 140 may control static pressure of the left speaker to a maximum value or control the static pressure of the right speaker to a minimum value. In this case, as the localization gradually moves from a left side to a front side, the controller 140 may gradually increase the static pressure of the right speaker.

In more detail, when the relative azimuth angle Φ is 270°, the controller 140 may set the sound pressure of the left speaker to a maximum value and may control the sound pressure of the right speaker to a minimum value. As the relative azimuth angle Φ is increased from 270° to 360°, the controller 140 may move a direction from which a sound flows to a front side by increasing sound pressure of the right speaker.

In an embodiment of the present disclosure, the controller 140 controls the sound according to localization determined based on the relative height H, the relative altitude Ψ, or the relative distance L.

Referring again to FIG. 4, the controller 140 may determine the relative height H by using an altitude difference between the portable device 100 and the counterpart portable device 100-1. Further, the controller 140 may determine the relative altitude Ψ based on the relative height H and a distance L between the portable device 100 and the counterpart portable device 100-1.

Figure 8:
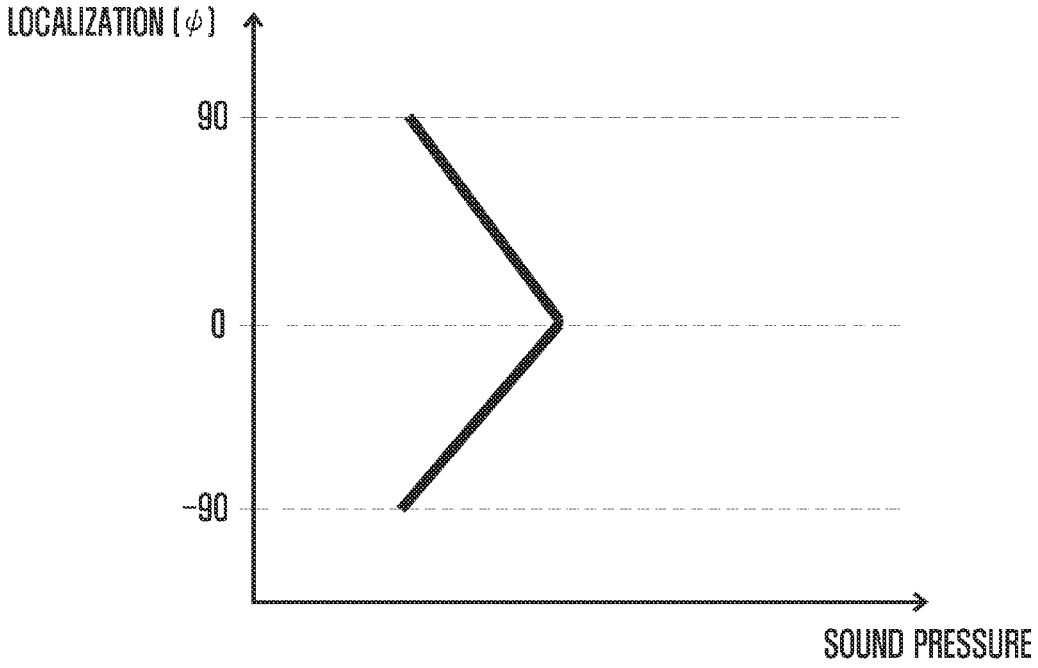
FIG. 8 is a graph illustrating an example of controlling a sound pressure of a speaker according to an embodiment of the present disclosure.

FIG. 8 is a graph illustrating an example of controlling a sound pressure according to a relative altitude according to an embodiment of the preset disclosure.

Referring to FIG. 8, when the altitude of the counterpart portable device 100-1 is the same as the altitude of the portable device 100, that is, when the relative altitude Ψ is 0°, the controller 140 may control the sound pressure to a maximum value.

Further, the controller 140 may control the sound pressure inversely proportional to an absolute value of the relative height H or the relative altitude Ψ. In more detail, as the relative height H between the portable device 100 and the counterpart portable device 100-1 is increased, that is, when the relative altitude Ψ is reduced from 0° to −90° or is increased from 0° to 90°, the controller 140 may control to gradually reduce sound pressure. In addition, as the relative distance L is increased, the controller 140 may control the sound pressure of the sound so that the sound pressure may be reduced inversely proportional thereto.

The controller 140 controls the sound output unit 150 to output a sound according to sound pressure determined based on the localization. The sound output unit 150 may output the sound through a speaker or an earphone. When a wireless headset or a wireless earphone is connected to the portable device 100, the controller 140 may transmit information of sound pressure determined by a wireless headset or a wireless earphone through the communication unit 110.

In an embodiment of the present disclosure, the sound may be a receiving sound of a counterpart to execute a call. The receiving sound is transmitted from the counterpart portable device 100-1 and may be included in a wireless signal received through the communication unit 110.

The sound may include a bell sound. The bell sound is stored in the memory 160, and may be set by the user, and may be individually set by the counterpart portable device 100-1. The controller 140 controls localization of the bell sound such that the user may intuitively recognize a location of the counterpart portable device 100-1 before beginning a call. Of course, the sound may be other than a bell sound.

Referring again to FIG. 2, the controller 140 determines whether a call termination event is generated at operation 280.

If a wireless signal for terminating a call is received through the communication unit 110 or an input for terminating the call is detected through the input unit 120, the controller 140 determines that a call termination event is generated. If the call termination event is not generated, the controller 140 may determine whether a location change event is generated at operation 290.

The controller 140 may randomly or periodically collect location information of the portable device 100. Further, the controller 140 may randomly or periodically transmit a message to the counterpart portable device 100-1 requesting location information to collect the location information of the counterpart portable device 100-1. The controller 140 may analyze the received location information of the portable device 100 and the counterpart portable device 100-1 to determine whether a location change event is generated.

If the location change event is generated, the controller 140 returns to an operation of collecting location information of the portable device 100 and receiving location information of the counterpart portable device 100-1 transmitted from the counterpart portable device 100-1 and collects the changed location information at operation 250.

When a location change event occurs for at least one of the portable device 100 or the counterpart portable device 100-1, the controller 140 newly collects location information of the changed location.

A method of newly collecting location information by the controller 140 is performed by the foregoing method.

The controller 140 performs the above described localization control operation of sound based on the changed location information. The controller 140 may randomly or periodically determine the location change until the call termination event is generated to repeatedly perform the localization control operation of a sound.

If it is determined in operation 290 that the location change event is not generated, the controller 140 outputs a sound according to localization determined based on previously collected location information at operation 270.

When the locations of the portable device 100 and the counterpart portable device 100-1 are not changed, the controller 140 outputs the sound according to previously determined localization based on the previously collected location information of the portable device 100 and the counterpart portable device 100-1.

The controller 140 may continuously output the sound according to previously determined localization until the call termination event is generated or the location change event is generated. If the call termination event is generated, the controller 140 terminates a call and stops the localization control operation of a sound according to the present disclosure.

The controller 140 may delete the location information of the portable device 100 and the counterpart portable device 100-1 or the information of localization control stored in the memory 160, in response to the call termination event. As the call is terminated, the controller 140 returns to an idle state and may repeatedly perform the foregoing operation.

The localization control method of a sound for a portable device and a portable device thereof according to the present disclosure allows a user to intuitively perceive the location of a counterpart user without viewing the display unit during a call with the counterpart user.

The localization control method of a sound for a portable device and a portable device thereof according to the present disclosure can conveniently perceive location information by a user having visual disturbance based on localization of a sound.

The localization control method of a sound for a portable device and a portable device thereof according to the present disclosure can provide an emotional function that serves as if exchanging real glances with a counterpart by turning a user's eyes on localization during a calling or conference through a stereoscopic image.

While the present disclosure has been shown and described with reference to various embodiments thereof, it will be understood by those skilled in the art that various changes in form and details may be made therein departing from the spirit and scope of the present disclosure as defined in the appended claims and their equivalents.

What is claimed is:

1. A localization control method of a sound for a portable device, the method comprising:

collecting a first location information of the portable device and receiving a second location information of a counterpart portable device when an event for communicating with the counterpart portable device by the portable device is generated;

determining localization of the sound to be output, the localization including a direction of the sound or a sense of distance, based on the first location information and the second location information; and outputting the sound according to the determined localization.

2. The method of claim 1, wherein the second location information of the counterpart portable device comprises at least one of information of the counterpart portable device's actual location and information of a location designated by the counterpart portable device.

3. The method of claim 1, wherein the collecting of the first location information comprises measuring at least one of a latitude, a longitude, an azimuth, and an azimuth angle of the portable device and the counterpart portable device.

4. The method of claim 1, wherein the collecting of the first location information comprises:

transmitting a request message for collecting the first location information to the counterpart portable device; and receiving the second location information transmitted from the counterpart portable device.

5. The method of claim 1, wherein the determining of the localization of the sound comprises:

calculating a relative azimuth angle indicating an azimuth angle of the counterpart portable device for an azimuth angle of the portable device based on the location information of the portable device and the counterpart portable device; and determining localization of the sound according to the relative azimuth angle.

6. The method of claim 1, wherein the outputting of the sound comprises:

determining a static pressure of a left speaker and a static pressure of a right speaker of the portable device according to the localization; and outputting the sound to the left speaker and the right speaker according to the determined static pressures.

7. The method of claim 6, wherein the determining of the static pressures of the left speaker and the right speaker comprises:

determining that the static pressures of the left speaker and the right speaker may be proportionally reduced as the counterpart portable device approaches a front of the portable device;

determining that the static pressure of the left speaker is proportionally greater than the static pressure of the right speaker as the counterpart portable device approaches a left side of the portable device;

determining that the static pressure of the right speaker is proportionally greater than the static pressure of the left speaker as the counterpart portable device approaches a right side of the portable device; and determining that the static pressures of the left speaker and the right speaker are proportionally reduced as the counterpart portable device approaches a rear side of the portable device.

8. The method of claim 1, wherein the determining of the localization of the sound comprises:

calculating a height difference between the portable device and the counterpart portable device by using the location information of the portable device and the location information of the counterpart portable device; and determining the localization of the sound according to the height difference.

9. The method of claim 8, wherein the outputting of the sound comprises:

determining a static pressure of the left speaker and a static pressure of the right speaker so that a difference of the static pressures of the left speaker and the right speaker may be reduced in proportion to the height difference; and outputting the sound to the left speaker and the right speaker according to the determined static pressures.

10. The method of claim 8, wherein the outputting of the sound comprises transmitting data including the static pressure to at least one of a speaker, an earphone, a headset, and a headphone connected to the portable device.

11. The method of claim 1, wherein the sound comprises at least one of a receiving sound and a bell sound.

12. The method of claim 1, further comprising:

collecting changed location information of the portable device and the counterpart portable device when a location change event of at least one of the portable device and the counterpart portable device occurs; and determining the localization of the sound based on the changed location information.

13. The method of claim 1, wherein the collecting of the location information comprises:

determining whether a localization mode of the portable device and the counterpart portable device is set; and collecting location information of the portable device and the counterpart portable device when the localization mode of the portable device and the counterpart portable device is set.

14. A portable device comprising:

a communication unit configured to transmit and receive data to and from a counterpart portable device;

a sensor unit configured to collect location information;

a sound output unit configured to output a sound; and a controller configured to, when an event for communicating with the counterpart portable device is generated, collect a first location information of the portable device through the sensor unit, collect a second location information transmitted from the counterpart portable device through the communication unit, determine localization of the sound, the localization including a direction of the sound or a sense of distance, based on the first location information and the second location information, and control the sound output unit to output the sound according to the determined localization.

15. The portable device of claim 14, wherein the second location information transmitted from the counterpart portable device comprises at least one of information of the counterpart portable device's actual location and information of location designated by the counterpart portable device.

16. The portable device of claim 14, wherein the sensor unit comprises at least one of a Global Positioning System (GPS) sensor configured to collect latitude information and longitude information by using a GPS satellite signal, a geomagnetic sensor configured to collect azimuth information and azimuth angle information by measuring a geomagnetic field, and a gyro sensor configured to collect azimuth information and azimuth angle information based on a rotation angle for a three-dimensional axis.

17. The portable device of claim 14, wherein the controller is further configured to control the communication unit to transmit a request message for collecting the first location information to the counterpart portable device, and to receive the second location information transmitted from the counterpart portable device.

18. The portable device of claim 16, wherein the controller is further configured to determine the localization of the sound based on the azimuth angle and an azimuth angle of the counterpart portable device.

19. The portable device of claim 18, wherein the sound output unit comprises a left speaker and a right speaker, and the controller is further configured to determine a static pressure of the left speaker and a static pressure of the right speaker so that a difference between the static pressures of the left speaker and the right speaker may be proportionally reduced as the counterpart portable device approaches a front of the portable device, so that the static pressure of the left speaker is proportionally greater than the static pressure of the right speaker as the counterpart portable device approaches a left side of the portable device, so that the static pressure of the right speaker is proportionally greater than the static pressure of the left speaker as the counterpart portable device approaches a right side of the portable device, and so that the static pressures of the left speaker and the right speaker are proportionally reduced as the counterpart portable device approaches a rear side of the portable device.

20. The portable device of claim 14, wherein the sensor unit comprises at least one of a Global Positioning System (GPS) sensor to measure an altitude by using a GPS signal, an altitude sensor to measure the altitude based on an atmospheric pressure or a satellite signal, and an atmospheric pressure sensor to measure the atmospheric pressure.

21. The portable device of claim 14, wherein the sound output unit comprises a left speaker and a right speaker, and the controller is further configured to calculate a height difference with the counterpart portable device based on the location information, and determine a static pressure of the left speaker and a static pressure of the right speaker so that a difference of the static pressures of the left speaker and the right speaker may be reduced in proportion to the height difference.

22. The portable device of claim 14, wherein the controller is further configured to collect changed location information when at least one location change event is generated from the portable device and the counterpart portable device and determine the localization of the sound based on the changed location information.

* * * * *